United States Patent [19]

Losenno

[11] 4,205,692

[45] Jun. 3, 1980

[54] VAPOR HOOD

[76] Inventor: Luigi G. Losenno, 4525 Drexel Ave. South, Edina, Minn. 55424

[21] Appl. No.: 919,128

[22] Filed: Jun. 26, 1978

[51] Int. Cl.[2] ..... A47K 3/12; A45D 7/02; A45D 7/12

[52] U.S. Cl. ..... 132/9; 4/537

[58] Field of Search ..... 132/9; 128/256, 367–368; 4/159, 160–163; 2/174; 122/508

[56] References Cited

U.S. PATENT DOCUMENTS

| | | | |
|---|---|---|---|
| 1,148,953 | 8/1915 | Caldwell | 4/165 |
| 1,637,077 | 7/1927 | Herrera | 4/165 |
| 1,650,270 | 11/1927 | Hamlet | 273/181 J |
| 1,970,013 | 8/1934 | Mahmourian | 128/257 |
| 2,331,065 | 10/1943 | Willat | 132/36 |
| 2,566,531 | 9/1951 | Nissenbaum | 4/165 |
| 2,694,206 | 11/1954 | Foster | 4/165 |
| 2,855,939 | 10/1958 | Braskamp | 132/9 |
| 3,351,737 | 11/1967 | Katzman et al. | 219/271 |
| 3,768,483 | 10/1973 | Kusunoki | 128/368 |
| 3,854,148 | 12/1974 | La Rose | 4/159 |
| 3,916,917 | 11/1975 | Hubbert | 132/9 |

*Primary Examiner*—Louis G. Mancene
*Assistant Examiner*—Michael J. Foycik, Jr.
*Attorney, Agent, or Firm*—Wicks & Nemer

[57] ABSTRACT

Vapor hood for covering the head of the user for enabling water vapor to surround the user's head freely and penetrate the user's hair equally during hair treatment is disclosed for use with a sink including a hot water faucet. The vapor hood is formed from a self-supporting, vapor impervious, non-flexible, dome shaped member including a head opening allowing placement of the head of the user within the interior of the dome shaped member. The dome shaped member has dimensions such that the water vapor can freely surround the head of the user located within the interior of the dome shaped member. The vapor hood can further include a flexible, impervious member removably attached to and around the base of the dome shaped member for vaporously sealing the base of the dome shaped member with the sink. Additionally, the vapor hood can further include a flexible, impervious member removably attached around the head opening in the dome shaped member for vaporously sealing the head opening of the dome shaped member with the head of the user. Alternately, the vapor hood can further include a self-supporting, vapor impervious, non-flexible member removably attached around the head opening in the dome shaped member for directing water vapor to the face of the user from the head opening in the dome shaped member.

39 Claims, 5 Drawing Figures

VAPOR HOOD

BACKGROUND

The present invention relates generally to vapor hoods.

Due to the increasing popularity of hair treatments such as cream or oil conditioners, permanent waves, color, and bleaching, hair may become damaged by successive or numerous treatments. Thus, a need has arisen to restore the original structure of the hair and skin. One method of restoration is providing the presence of water vapor to the hair of the user. Therefore, a need has arisen for a device that enables water vapor to surround the user's head freely and thus indirectly and gradually penetrate all the user's hair equally to its maximum absorption and not to saturate the user's hair.

SUMMARY

The present invention solves these and other problems in hair treatments by providing, in the preferred embodiment, a vapor hood comprised of a self-supporting, impervious, non-flexible, dome shaped member. The dome shaped member includes an opening allowing placement of the head of the user within the interior of the dome shaped member. The dome shaped member has a height greater than the height of the head of the user such that the water vapor can freely surround the head of the user located within the interior of the dome shaped member.

It is thus an object of the present invention to provide a novel vapor hood.

It is further an object of this invention to provide such a novel vapor hood which is sanitary, safe, and lightweight.

It is further an object of this invention to provide such a novel vapor hood which enables the water vapor to surround the head freely and thus penetrate all the user's hair equally.

It is further an object of this invention to provide such a novel vapor hood which allows the water vapor to indirectly and gradually penetrate the user's hair to its maximum absorption without superficially saturating the user's hair.

These and further objects and advantages of the present invention will become clearer from and in light of the following detailed description of illustrative embodiments of this invention described in connection with the drawings.

DESCRIPTION OF THE DRAWINGS

The illustrative embodiments may best be described by reference to the accompanying drawings where.

Figure 1:
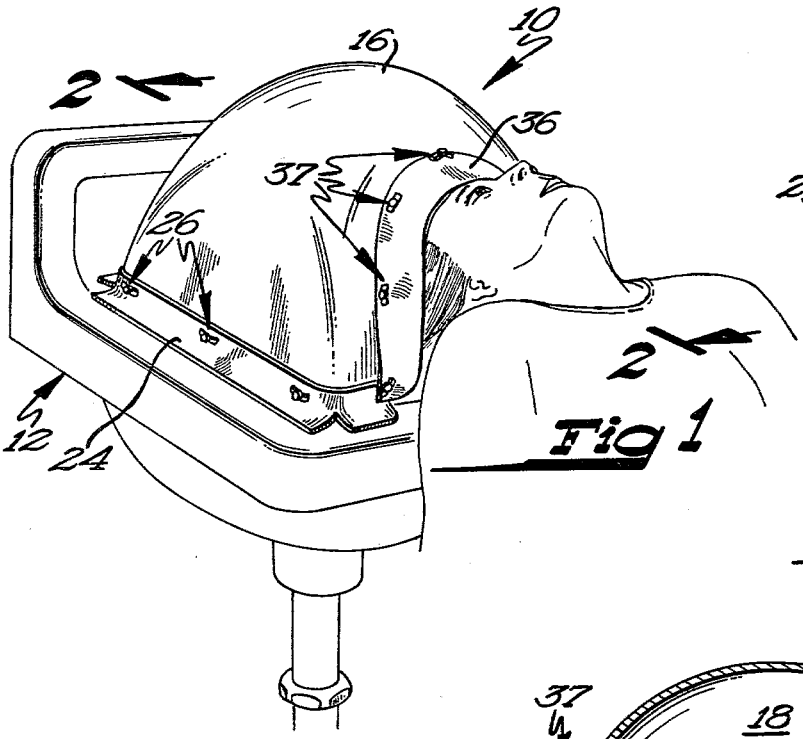
FIG. 1 shows a perspective view of a vapor hood according to the teachings of the present invention in use with a conventional sink.

Where used in the various figures of the drawings, the same numerals designate the same or similar parts in the vapor hood. Furthermore, when the terms "horizontal", "vertical", "height", "width", "length", and similar terms are used herein, it should be understood that these terms have reference only to the structure shown in the drawings as it would appear to a person viewing the drawings and are utilized only to facilitate describing the invention.

All figures are drawn for ease of explanation of the basic teachings of the present invention only; the extensions of the figures with respect to number, position, relationship, and dimensions of the parts to form preferred embodiments will be explained or will be obvious from the explanation set out.

DESCRIPTION

In the figures, a vapor hood according to the teachings of the present invention for helping to restore the original structure of the hair and skin of a user with the presence of water vapor is generally shown and designated 10. Hood 10 is shown in use with a receptacle 12 shown as a conventional sink and in the preferred embodiment as a commercial shampoo bowl. Sink 12 includes a horizontal opening 13 and at least a hot water faucet 14 directed into the horizontal opening 13 of sink 12 for supplying hot water to sink 12, as is conventional.

Hood 10 includes a self-supporting, vapor impervious, non-flexible, dome shaped member 16. In the preferred embodiment, member 16 is formed from molded plastic. Member 16 defines an interior 18 and includes a base 20. The size of the base 20 is approximately equal to the size of opening 13 of sink 12 such that member 16 can be placed over opening 13 in sink 12 and be supported by sink 12 without falling in. Base 20, however, is of a size larger than the size of the head of the user. Additionally, in the preferred embodiment, base 20 is of a size such that faucet 14 is located in the interior 18 of dome shaped member 16. In the preferred embodiment, base 20 is of a rectangular cross section to enable it to fit different sizes of sinks 12. For example, if sink 12 has an oval shaped opening 13 wherein one dimension is considerably greater than the other dimension, base 20 will be supported on sink 12 although one dimension of opening 13 of sink 12 is greater than the dimension of base 20 such that member 16 will not fall into sink 12.

Member 16 further includes a frontal opening 22 for allowing the horizontal placement of the head of the user within interior 18 such that the hair of the user is located within interior 18 of member 16. Specifically, opening 22 allows a user to place her head over sink 12 with the back of her head being directed into sink 12 and the user looking out of sink 12, as is conventional in barber and beauty shops, such that member 16 can be placed over the upper head of the user with opening 22 being adjacent to the forehead of the user and with the hair of the user located in the interior 18 of member 16, as best seen in FIG. 1.

Figure 3:
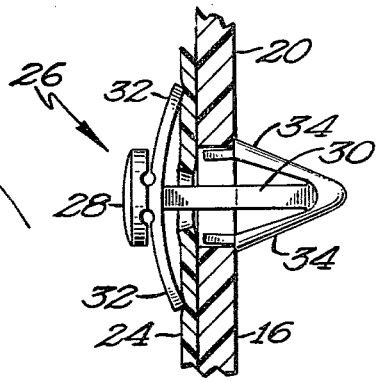
FIG. 3 shows an enlarged, partial sectional view of the vapor hood of FIG. 1 according to the Section line 3—3 of FIG. 2.
Figure 2:
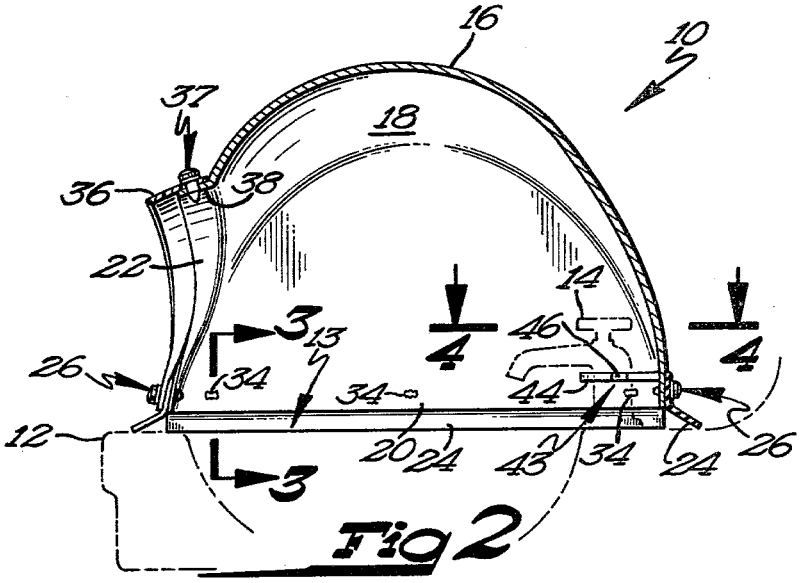
FIG. 2 shows a sectional view of the vapor hood of FIG. 1 according to the Section line 2—2 of FIG. 1.

A member for vaporously sealing base 20 of member 16 with sink 12 can further be provided for hood 10 of the present invention. In the preferred embodiment, the sink sealing member includes a flexible, canvas-type, vapor impervious band member 24 which extends around base 20 of member 16, and also includes members 26 for attaching member 24 around and to base 20 of member 16. In the preferred embodiment, members 26 allow for the removable attachment of member 24 to base 20. In the preferred embodiment as best seen in FIG. 3, members 26 are of conventional design and include a head 28, a middle shaft 30, a leaf spring member 32 for abutting with member 24 and head 28, and wings 34 for abutting with the inside surface of dome shaped member 16. Member 26 can then be inserted through apertures formed in member 24 and member 16. Specifically, spring member 32 and wings 34 retain member 26 in the apertures to hold members 24 and 16 together. To remove member 26, wings 34 can be pressed together allowing them to pass through the apertures formed in members 16 and 26.

It can now be appreciated that the sink sealing member in conjunction with the rectangular shape of base 20 allows hood 10 to fit various size sinks. For example, as explained hereinbefore for an oval-shaped sink 12, member 24 extends and covers the portion of the opening of sink 12 extending beyond base 20 of member 16 such that water vapor is not allowed to escape therethrough to the exterior of member 16.

A member for vaporously sealing opening 22 with the head of the use can further be provided for hood 10 of the present invention. The opening sealing member is shown in the preferred embodiment as a flexible, canvas-type, vapor impervious band member 36 which extends around opening 22, and members 37 for attaching member 36 to member 16 around opening 22. In the preferred embodiment, member 16 includes a horizontally directed, outwardly projecting flange 38 around opening 22 for abutting with the head of the user such that the head of the user is not exposed to a sharp edge and which allows for attachment of member 36 in a generally horizontal manner. In the preferred embodiment, members 37 are of the same construction as member 26.

In can then be appreciated that member 36 rests on the head of the user for vaporously sealing opening 22 to prevent the escape of water vapor from the interior 18 of member 16 around the user's head through opening 22.

Figure 5:
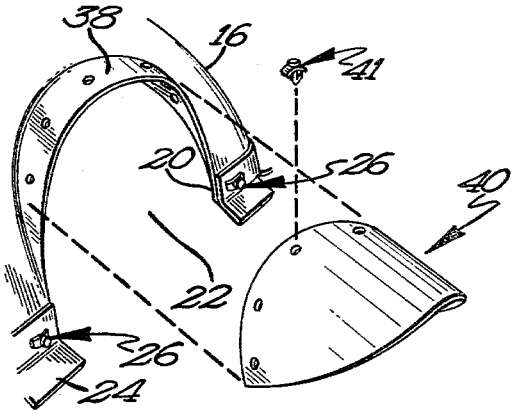
FIG. 5 shows a perspective view of a member which can be used with the vapor hood of FIG. 1.

A member for supplying facial water vapor to the face of the user can alternately be provided for hood 10 of the present invention. As seen in FIG. 5, the facial member as shown in the preferred embodiment is a self-supporting, vapor impervious, non-flexible member 40 for directing water vapor to the face of the user from opening 22 of member 16, and members 41 for connecting member 40 to member 16 adjacent to the opening 22. In the preferred embodiment, member 40 is attached to flange 38 such that member 40 is held in a horizontal manner adjacent to the face of the user such that the water vapor from opening 22 is directed to and confined by the face of the user. Further, in the preferred embodiment, members 41 are of the same construction as members 26.

It should then be noted that, due to the removability of members 26, 37, and 41, members 24, 36, and 40 can be removed and sanitized after each use of hood 10 such that hood 10 is very sanitary and hygienic.

It should then be further noted that although, in the preferred embodiment, members 26, 37, and 41 attach members 24, 36, and 40, respectively, to member 16, it would be obvious to use different attachment means for one or more of the members 24, 36, or 40, such as by snaps or to fixably secure members 24, 36, or 40 to member 16 such as by glue.

During various hair treatments such as any cream or oil conditioner, permanent wave, color or bleaching, hot water vapor can then be provided to help restore the original structure of the hair and skin. Prior to the present invention, water vapor was directly applied such as by directing steam from a suitable steam generator which could be of the electrically controlled type through a hose to a bonnet located on the head of the user. However, such directly applied water vapor hits the user's hair too quickly and thus superficially saturates the hair rather than penetrating the user's hair. Additionally, the user was subjected to the possibility of burns caused by the directly applied hot water vapor.

In the preferred embodiment of the present invention, water vapor is produced by hot water. In the preferred embodiment, hot water is produced by faucet 14 and supplied to sink 12 such that water vapor produced in sink 12 is confined by member 16. It should then be noted that water vapor produced by the present invention overcomes the disadvantages of the prior art. Specifically, the water vapor is not directly applied to the hair and therefore does not superficially saturate the hair as in the prior art. Further, the possibility of burns to the user from the application of such hot vapor directly to hair is eliminated. Additionally, a steam generator is not required and thus hood 10 of the present invention provides an inexpensive device for providing the presence of hot water vapor in that only a source of hot water is required.

Figure 4:
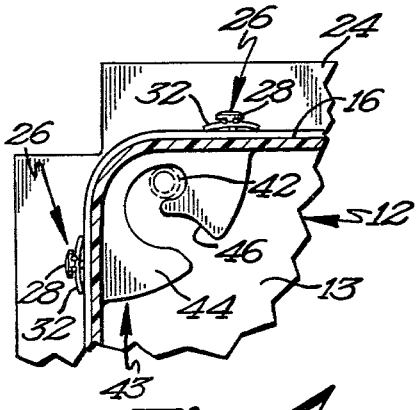
FIG. 4 shows a partial sectional view of the vapor hood of FIG. 1 according to the Section line 4—4 of FIG. 2.

In an alternate embodiment as best seen in FIG. 4, if the use of faucet 14 is not desired or if faucet 14 is located such that it will not be located within the interior 18 of member 16, hose 42 can be provided from a source of hot water for directing the hot water into sink 12 or other receptacle. A member 43 for clamping hose 42 in place in member 16 to keep hose 42 from moving within interior 18 of member 16 due to variation of the water pressure or other reason can be provided in the form of clamp member 43. Clamp member 43 controls the direction of the hot water spray so that it will not be directed at the head of the user. In the preferred embodiment, clamp member 43 is shown as a plate 44 attached to member 16 within interior 18 having a S-shaped slot 46 formed therein for removably receiving hose 42.

Prior to the present invention, in an effort to confine water vapor adjacent to the hair of the user, a cape, sheet, or cloth which was flexible in nature was positioned and supported over the head of the user. However, the capes, sheets, or cloths of the prior art, due to their flexible nature, would sag and lie flat against the head of the user, especially once the sheet became saturated from the water vapor. If the flexible sheet lies against the head of the user, it blocks the free flow of vapor around the head. Additionally, if such a flexible sheet were spaced at a large distance such that when it became saturated with water vapor, it would not lie on the head of the user, due to the large interior volume created by the large distance, it would not confine the water vapor around the user's head.

The present invention overcomes this disadvantage by providing member 16 in the form of self-supporting and non-flexible member. Specifically, due to its self-supporting and non-flexible nature, member 16 will not move towards the head of the user, as the water vapor condenses on the interior of member 16, and thus member 16 of the present invention will maintain its shape at all times.

Additionally, it should be noted that member 16 has dimensions such that the water vapor can freely surround the head of the user located within the interior 18 of member 16. In the preferred embodiment, the height of member 16 is high, particularly is greater than the height of the head of the intended user, and is specifically approximately equal to 12 inches. Further, the base, in the preferred embodiment, has a size greater than the head of the intended user and specifically has a width of 14½ inches along the side in which opening 22 is formed and a length of 15½ inches.

Furthermore, member 16 has dimensions such that the water vapor is confined adjacent to the hair of the user. Specifically, the interior volume dimensions of member 16 are not so large that the water vapor is not confined. It should then be noted that the use of flexible sheet members, as in the prior art, required that the flexible sheet member be of a large size such that, at least in one dimension and probably all three, the water vapor was not confined. The present invention overcomes this disadvantage due to its dimensions as set forth above.

A further feature of the present invention can now be explained as shown in the preferred embodiment. It should be noted that, due to the dome shape of member 16, the slope of the walls of member 16 is large, and approaches a vertical slope, to allow the water vapor to surround the head of the user freely and thus penetrate all of the user's hair equally.

Further, it should be noted that due to the provision of members 24 and 26, the base of member 16 can be of a relatively small size such that the water vapor can be confined by member 16 and still allow member 16 to fit various size sinks without the water vapor escaping past the exterior of member 16.

It can now be appreciated that hood 10 according to the teachings of the present invention provides a sanitary, safe, light weight device for confining water vapor during hair treatment. Due to the particular shape, height, and dimensions as set forth hereinbefore, hood 10 enables water vapor to surround the head freely and thus penetrate all the hair equally. Further, due to the self-supporting, non-flexible nature of member 16 as set forth hereinbefore, it will not sag as the water vapor condenses on the inside surfaces of member 16 such that hood 10 will not lie on the user's head as in the prior art. Further, the indirect applied steam produced by the use of hot water as set forth hereinbefore is an indirect and gradual means of penetrating the hair to its maximum absorption of water vapor rather than superficially saturating the hair as in the prior art where directly applied steam as from a steam generator hits the hair too quickly and directly and thus superficially saturates rather then penetrates the hair.

Now that the basic teachings of the present invention have been explained, many extensions and variations will be obvious to one having ordinary skill in the art. For example, although in the preferred embodiment of the present invention, plate 44 is provided for clamping hose 42 if it is not desired to use faucet 14 or if faucet 14 is located outside of the interior 18 of member 16, it should be noted that plate 44 can be omitted from member 16 if desired.

Thus, since the invention disclosed herein may be embodied in other specific forms without departing from the spirit or the general characteristics thereof, some of which forms have been indicated, the embodiments described herein are to be considered in all respects illustrative and not restrictive. The scope of the invention is indicated by the appended claims, rather than by the foregoing description, and all changes which come within the meaning and range of equivalency of the claims are intended to be embraced therein.

What is claimed is:

1. Vapor hood for covering the hair of the user for enabling water vapor to surround freely and penetrate the hair equally during hair treatment without superficially saturating the hair for use with a receptacle having a horizontal opening and means for supplying hot water to the receptacle for indirectly and gradually producing water vapor to be confined by the vapor hood, comprising, in combination: a self-supporting, vapor impervious, non-flexible dome shaped member including a base and an interior, with the size of the base being approximately equal to the size of the opening of the receptacle such that the member can be placed over the opening of the receptacle and be supported by the receptacle and with the size of the base being larger than the size of the head of the user, with the member including a frontal, head opening allowing the horizontal placement of the head of the intended user such that the hair of the user is located within the interior of the member, with the height of the member being greater than the height of the head of the intended user such that the water vapor can freely surround the head of the user located within the interior of the member, and with the dimensions of the member allowing the confinement of the water vapor adjacent to the user's hair; and means for vaporously sealing the base of the member with the receptacle.

2. The vapor hood of claim 1 wherein the sealing means comprises, in combination: a flexible, vapor impervious member; and means for attaching the flexible, vapor impervious member around the base of the dome shaped member.

3. The vapor hood of claim 1 further comprising means for vaporously sealing the opening of the dome shaped member with the head of the user.

4. The vapor hood of claim 3 wherein the sealing means comprises, in combination: a flexible, vapor impervious member; and means for attaching the flexible, vapor impervious member around the opening of the dome shaped member.

5. The vapor hood of claim 1 wherein the hot water supplying means comprises a hot water faucet directed into the receptacle, with the base of the dome shaped member being of a size such that the hot water faucet is located in the interior of the dome shaped member.

6. Vapor hood for covering the hair of the user for enabling water vapor to surround freely and penetrate the hair equally during hair treatment without superficially saturating the hair for use with a receptacle having a horizontal opening and means for supplying hot water to the receptacle for indirectly and gradually producing water vapor to be confined by the vapor hood, comprising, in combination: a self-supporting, vapor impervious, non-flexible dome shaped member including a base and an interior, with the size of the base being approximately equal to the size of the opening of the receptacle such that the member can be placed over the opening of the receptacle and be supported by the receptacle and with the size of the base being larger than the size of the head of the user, with the member including a frontal, head opening allowing the horizontal placement of the head of the intended user such that the hair of the user is located within the interior of the member, with the height of the member being greater than the height of the head of the intended user such that the water vapor can freely surround the head of the user located within the interior of the member, with the dimensions of the member allowing the confinement of the water vapor adjacent to the user's hair, and wherein the hot water supplying means includes a hose for directing hot water into the receptacle and means for clamping the hose in place to the dome shaped member to keep the hose from moving within the interior of the dome shaped member.

7. Vapor hood for covering the hair of the user for enabling water vapor to surround freely and penetrate the hair equally during hair treatment without superficially saturating the hair for use with a receptacle having a horizontal opening and means for supplying hot water to the receptacle for indirectly and gradually producing water vapor to be confined by the vapor hood, comprising, in combination: a self-supporting, vapor impervious, non-flexible dome shaped member including a base and an interior, with the size of the base being approximately equal to the size of the opening of the receptacle such that the member can be placed over the opening of the receptacle and be supported by the receptacle and with the size of the base being larger than the size of the head of the user, with the member including a frontal, head opening allowing the horizontal placement of the head of the intended user such that the hair of the user is located within the interior of the member, with the height of the member being greater than the height of the head of the intended user such that the water vapor can freely surround the head of the user located within the interior of the member, and with the dimensions of the member allowing the confinement of the water vapor adjacent to the user's hair; and means for supplying facial water vapor to the head of the user.

8. The vapor hood of claim 7 wherein the facial water vapor means comprises, in combination: a self-supporting, vapor impervious, non-flexible member for directing water vapor to the face of the user from the opening in the dome shaped member; and means for connecting the member for directing water vapor to the face of the intended user from the interior of the dome shaped member adjacent to the opening in the dome shaped member.

9. The vapor hood of claim 7 wherein the hot water supplying means comprises a hot water faucet directed into the receptacle, with the base of the dome shaped member being of a size such that the hot water faucet is located in the interior of the dome shaped member.

10. The vapor hood of claim 7 wherein the hot water supplying means includes a hose for directing hot water into the receptacle; and means for clamping the hose in place to the dome shaped member to keep the hose from moving within the interior of the dome shaped member.

11. The vapor hood of claim 8 further comprising a horizontally directed, outwardly directed flange around the frontal, head opening for aubtting with the head of the user such that the head of the user is not exposed to a sharp edge.

12. The vapor hood of claim 11 wherein the water vapor directing member is connected by the connecting means to the flange such that the water vapor directing member is held in a horizontal manner adjacent to the face of the user such that the water vapor from the frontal, head opening is directed to and confined by the face of the user.

13. The vapor hood of claim 1 wherein the hot water supplying means includes a hose for directing hot water into the receptacle; and means for clamping the hose in place to the dome shaped member to keep the hose from moving within the interior of the dome shaped member.

14. The vapor hood of claim 1 further comprising, in combination: means for supplying facial water vapor to the head of the user.

15. The vapor hood of claim 14 wherein the facial water vapor means comprises, in combination: a self-supporting, vapor impervious, non-flexible member for directing water vapor to the face of the user from the opening in the dome shaped member; and means for connecting the member for directing water vapor to the face of the intended user from the interior of the dome shaped member adjacent to the opening in the dome shaped member.

16. The vapor hood of claim 15 further comprising a horizontally directed, outwardly directed flange around the frontal, head opening for abutting with the head of the user such that the head of the user is not exposed to a shape edge.

17. The vapor hood of claim 16 wherein the water vapor directing member is connected by the connecting means to the flange such that the water vapor directing member is held in a horizontal manner adjacent to the face of the user such that the water vapor from the frontal, head opening is directed to and confined by the face of the user.

18. The vapor hood of claim 4 further comprising a horizontally directed, outwardly directed flange around the frontal, head opening for abutting with the head of the user such that the head of the user is not exposed to a sharp edge.

19. The vapor hood of claim 6 further comprising, in combination: means for vaporously sealing the base of the member with the receptacle.

20. The vapor hood of claim 19 wherein the sealing means comprises, in combination: a flexible, vapor impervious member; and means for attaching the flexible, vapor impervious member around the base of the dome shaped member.

21. The vapor hood of claim 6 further comprising means for vaporously sealing the opening of the dome shaped member with the head of the user.

22. The vapor hood of claim 21 wherein the sealing means comprises, in combination: a flexible, vapor impervious member; and means for attaching the flexible, vapor impervious member around the opening of the dome shaped member.

23. The vapor hood of claim 22 further comprising a horizontally directed, outwardly directed flange around the frontal, head opening for abutting with the head of the user such that the head of the user is not exposed to a sharp edge.

24. The vapor hood of claim 6 further comprising, in combination: means for supplying facial water vapor to the head of the user.

25. The vapor hood of claim 24 wherein the facial water vapor means comprises, in combination: a self-suporting, vapor impervious, non-flexible member for directing water vapor to the face of the user from the opening in the dome shaped member; and means for connecting the member for directing water vapor to the face of the intended user from the interior of the dome shaped member adjacent to the opening in the dome shaped member.

26. The vapor hood of claim 25 further comprising a horizontally directed, outwardly directed flange around the frontal, head opening for abutting with the head of the user such that the head of the user is not exposed to a sharp edge.

27. The vapor hood of claim 26 wherein the water vapor directing member is connected by the connecting means to the flange such that the water vapor directing member is held in a horizontal manner adjacent to the face of the user such that the water vapor from the frontal, head opening is directed to and confined by the face of the user.

28. Vapor hood adapted to be used with a receptacle having a horizontal opening, comprising, in combination: a self-supporting, vapor impervious, dome shaped member including a base and an interior, with the size of the base being approximately equal to the size of the opening of the receptacle and with the member adapted to be placed over the opening of the receptacle and supported by the receptacle and with the size of the base being larger than the size of the head of the user, with the member including a frontal, head opening allowing the horizontal placement of the head of the intended user within the interior of the member, and with the height of the member being greater than the height of the head of the intended user; means for supplying hot, flowing water within the interior of the member for indirectly and gradually producing water vapor and causing such water vapor to become confined between the receptacle and the vapor hood, with the greater height of the member above the head of the intended user and the means for supplying hot, running water within the member cooperating for enabling water vapor to surround freely and penetrate the hair of the user equally during hair treatment without superficially saturating the hair.

29. The vapor hood of claim 28 further comprising, in combination: means for vaporously sealing the base of the member with the receptacle.

30. The vapor hood of claim 29 wherein the sealing means comprises, in combination: a flexible, vapor impervious member; and means for attaching the flexible, vapor impervious member around the base of the dome shaped member.

31. The vapor hood of claim 28 further comprising means for vaporously sealing the opening of the dome shaped member with the head of the user.

32. The vapor hood of claim 31 wherein the sealing means comprises, in combination: a flexible, vapor impervious member; and means for attaching the flexible, vapor impervious member around the opening of the dome shaped member.

33. The vapor hood of claim 32 further comprising a horizontally directed, outwardly directed flange around the frontal, head opening for abutting with the head of the user such that the head of the user is not exposed to a sharp edge.

34. The vapor hood of claim 28 wherein the hot, flowing water supplying means comprises a hot water faucet directed into the receptacle, with the base of the dome shaped member being of a size such that the hot water faucet is located in the interior of the dome shaped member.

35. The vapor hood of claim 28 wherein the hot, flowing water supplying means includes a hose for directing hot water into the receptacle; and means for clamping the hose in place to the dome shaped member to keep the hose from moving within the interior of the dome shaped member.

36. The vapor hood of claim 28 further comprising, in combination: means for supplying facial water vapor to the head of the user.

37. The vapor hood of claim 36 wherein the facial water vapor means comprises, in combination: a self-supporting, vapor impervious, non-flexible member for directing water vapor to the face of the user from the opening in the dome shaped member; and means for connecting the member for directing water vapor to the face of the intended user from the interior of the dome shaped member adjacent to the opening in the dome shaped member.

38. The vapor hood of claim 37 further comprising a horizontally directed, outwardly directed flange around the frontal, head opening for abutting with the head of the user such that the head of the user is not exposed to a sharp edge.

39. The vapor hood of claim 38 wherein the water vapor directing member is connected by the connecting means to the flange such that the water vapor directing member is held in a horizontal manner adjacent to the face of the user such that the water vapor from the frontal, head opening is directed to and confined by the face of the user.

* * * * *